US007368650B2

(12) United States Patent
Hsieh

(10) Patent No.: US 7,368,650 B2
(45) Date of Patent: May 6, 2008

(54) PEDAL ASSEMBLY

(75) Inventor: Wu-Hong Hsieh, Lu Chou (TW)

(73) Assignee: K.H.S. Musical Instrument Co., Ltd., Taipei Hsien (TW)

( * ) Notice: Subject to any disclaimer, the term of this patent is extended or adjusted under 35 U.S.C. 154(b) by 0 days.

(21) Appl. No.: 11/494,514

(22) Filed: Jul. 28, 2006

(65) Prior Publication Data

US 2008/0028915 A1 Feb. 7, 2008

(51) Int. Cl.
*G10D 13/02* (2006.01)

(52) U.S. Cl. ..... 84/422.1

(58) Field of Classification Search ..... 84/422.1, 84/422.2, 422.3, 426
See application file for complete search history.

(56) References Cited

U.S. PATENT DOCUMENTS

| | | | | |
|---|---|---|---|---|
| 4,567,808 | A * | 2/1986 | Smith | 84/422.1 |
| 6,100,460 | A * | 8/2000 | Hoshino | 84/422.1 |
| 7,131,520 | B2 * | 11/2006 | Drott et al. | 188/352 |
| 7,179,978 | B2 * | 2/2007 | Takegawa | 84/422.1 |

* cited by examiner

*Primary Examiner*—Kimberly Lockett
(74) *Attorney, Agent, or Firm*—Rosenberg, Klein & Lee

(57) ABSTRACT

A pedal assembly has a base and a pedal. The pedal is pivotally mounted on the base and has two mounting sleeve mounted between the base and the pedal. A resilient element is mounted between the mounting sleeves. A retaining element is secured to the base. Each mounting sleeve has a rubbing surface abutting against the pedal. Accordingly, gaps between the mounting sleeves and the pedal due to attrition will be automatically eliminated.

7 Claims, 5 Drawing Sheets

PEDAL ASSEMBLY

BACKGROUND OF THE INVENTION

1. Field of the Invention

The present invention relates to a pedal, and more particularly to a pedal assembly that can eliminate gaps caused by attrition.

2. Description of Related Art

Drums play a very important role in a music performance. Basically, a drum has a head and can be hit by drumsticks, mallet or brush to generate sound. As for a bass drum, when a user steps a pedal assembly, a beater connected to the pedal is driven to hit the bass drum for generating sound.

With reference to FIG. 5, a conventional pedal assembly comprises a base (42), an operational beater (43) and a pedal (41). The base (42) is normally mounted on the ground and has two ears (420). The pedal (41) is provided inclinedly on the base (42) and has an actuating end and a pivotal end. The pivotal end is pivotally mounted between the ears (420) of the base (42) and has two side surfaces being required to abut closely against the ears (420) to make the pedal (41) stable relative to the base (42). The operational beater (43) is mounted pivotally on the base (42), connects to the actuating end of the pedal (41) and is driven by the pedal (41). At least one resilient element (430) is connected to the beater (43) to make the beater (43) and the pedal (41) to return to an original position automatically, such that users can step the pedal (41) repeatedly.

When users step on the pedal (41), the pedal (41) will pivotally rotate relative to the ears (420) of the base (42) and drive the beater (43) to hit the head of the bass drum. Since the pedal (41) rotate relative to the ears (420), attrition between the ears (420) and the side surfaces of the pedal (41) abutting against the ears (420) are unavoidable and gaps are easily generated. The gaps will make the pedal (41) unstable relative to the base (42).

To solve said problems of the conventional pedal assembly, a worn pedal (41) is detached from the base (42) and is replaced with a new pedal. However, this is not only inconvenient, but also uneconomical.

To overcome the shortcomings, the present invention provides a pedal assembly to obviate or mitigate the aforementioned problems.

SUMMARY OF THE INVENTION

The main objective of the present invention is to provide a pedal assembly that can eliminate gaps caused by attrition of the pedal with a simple adjustment process.

To achieve the objective, the pedal assembly in accordance with the present invention comprises a base and a pedal.

The base has a mounting portion. The pedal has a pivotal end having two ears mounted pivotally with the mounting portion, two mounting sleeves, a resilient element and a retaining element. The mounting sleeves are mounted in the mounting portion of the base, and each mounting sleeve has a rubbing surface abutting against a corresponding ear. The resilient element is mounted between the mounting sleeves and pushes the mounting sleeves to abut against the ears. The retaining element is fixed on the base to hold the mounting sleeves securely in position.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
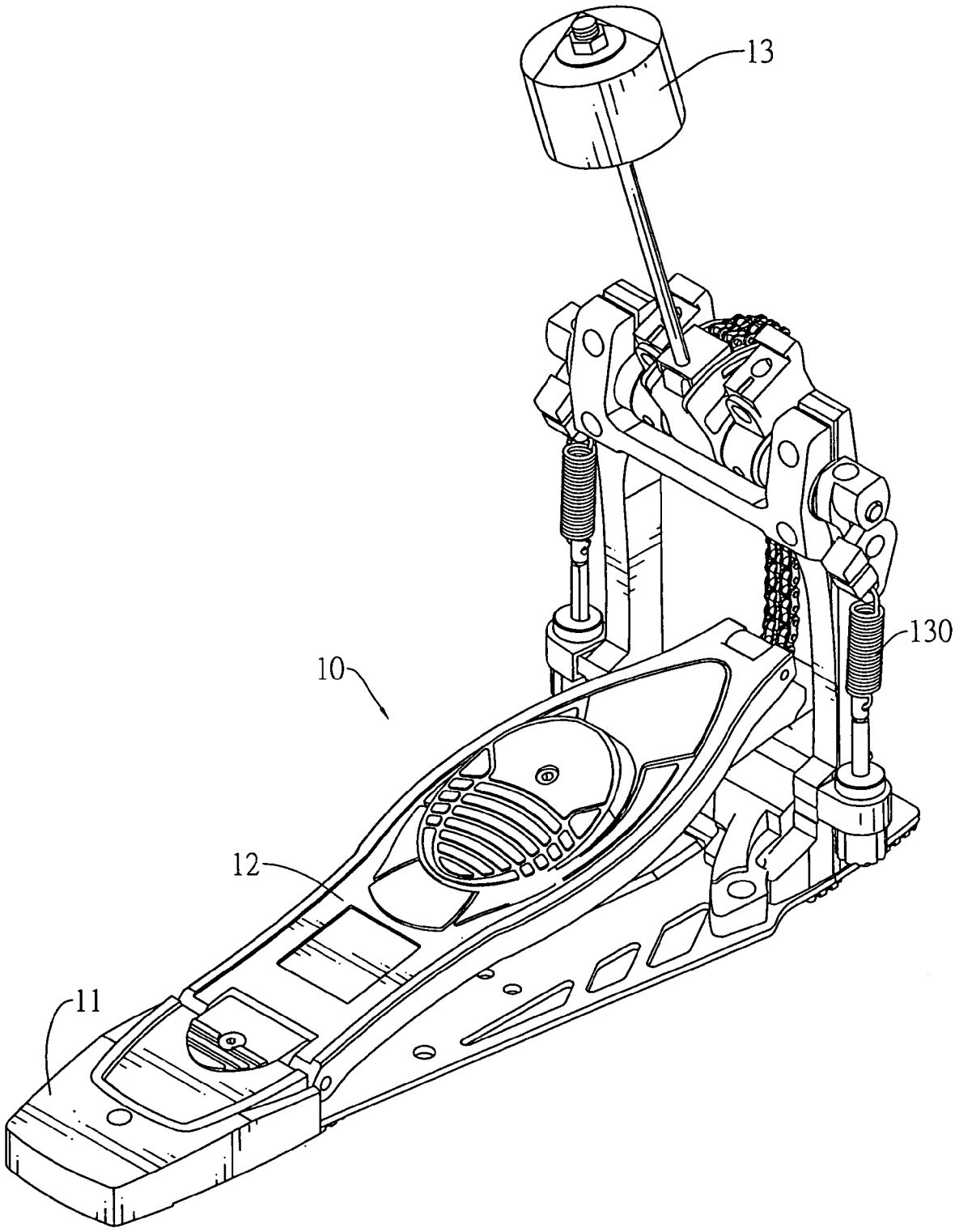
FIG. 1 is a perspective view of a pedal assembly in accordance with the present invention.
Figure 2:
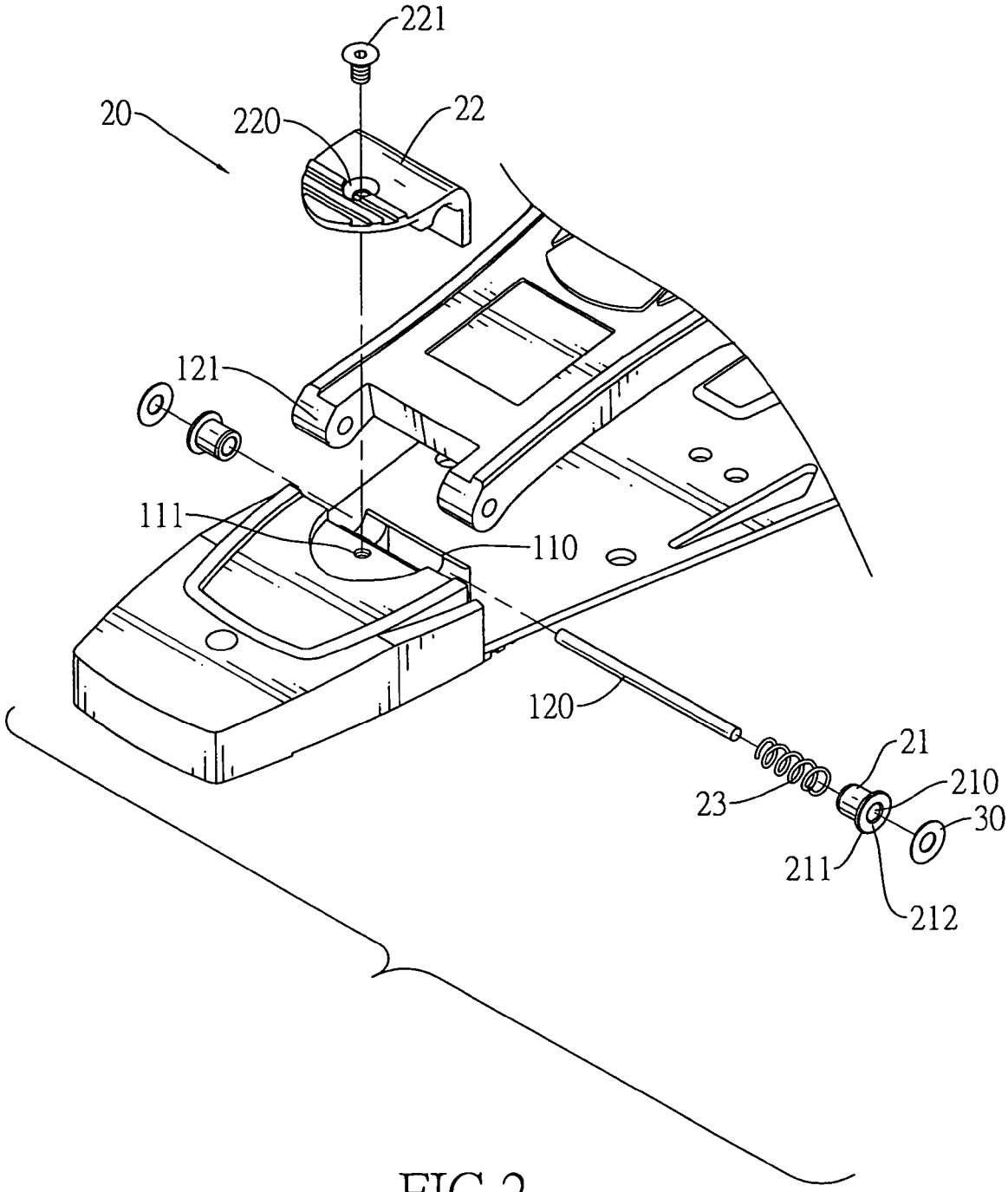
FIG. 2 is an exploded perspective view of the pedal assembly in FIG. 1.

With reference to FIGS. 1 and 2, the pedal assembly (10) in accordance with the present invention comprises a base (11), an operational beater (13) and a pedal (12).

The base (11) is mounted on the ground and has a mounting portion (110) and a threaded hole (111). The mounting portion (110) has a surface and a channel having two ends longitudinally formed on the surface. The threaded hole (111) is formed in the base (11) at a position beside the mounting portion (110).

The beater (13) is pivotally mounted on the base (11) and is connected with two springs (130) to return the beater (13) when the beater (13) is pivoting.

Figure 3:
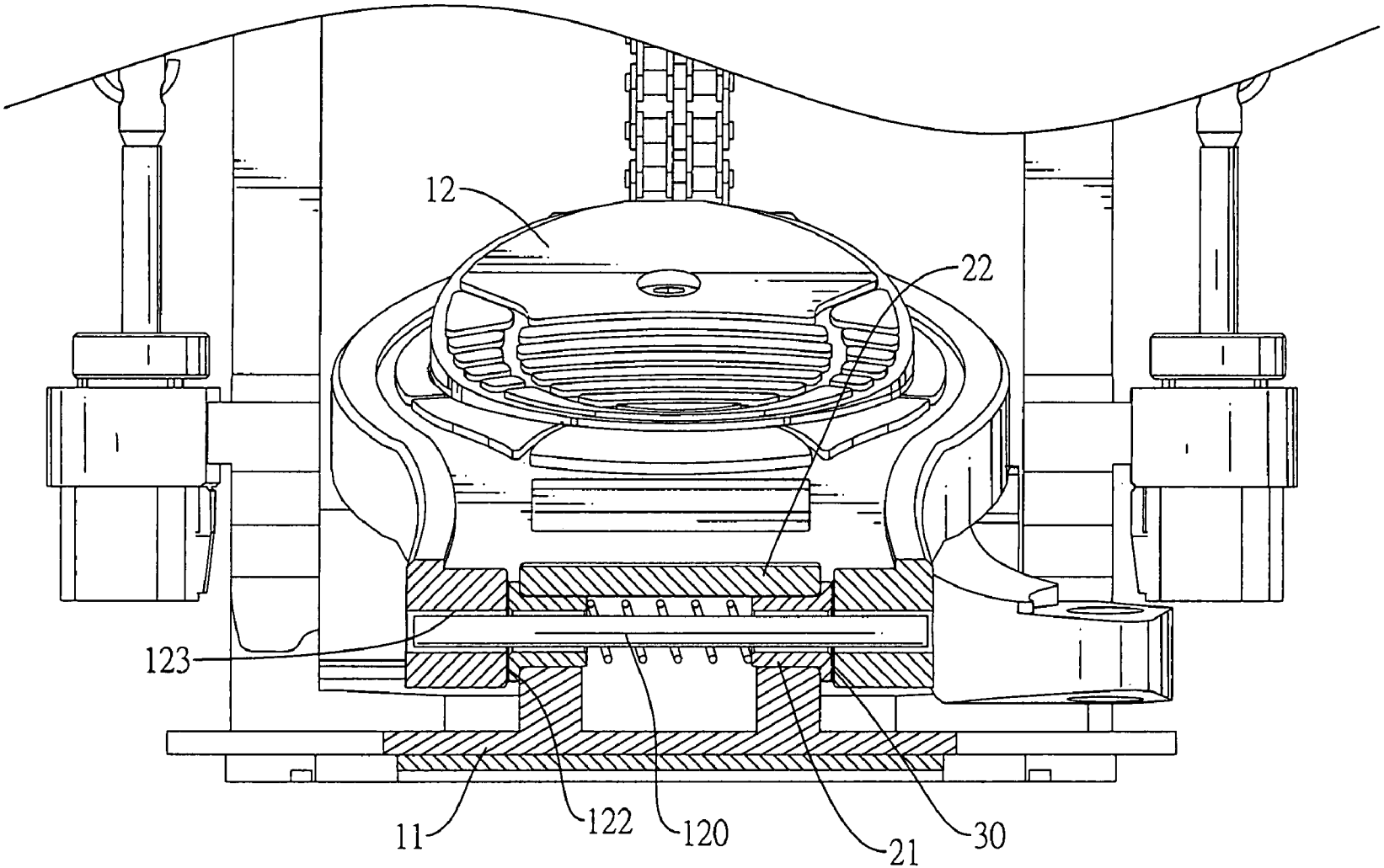
FIG. 3 is an end view in partial section of the pedal assembly in FIG. 1.

With further reference to FIG. 3, the pedal (12) is inclinedly connected to the base (11) and has an actuating end, a pivotal end, a shaft (120), two mounting sleeves (21), a resilient element (23), two optional spacers (30) and a retaining element (22).

The actuating end is connected to the beater (13) via a chain to drive the beater (13) to rotate and return to an original position with the resilient force provided by the springs (130).

The pivotal end has two sides and two ears (121) formed on the sides separately for receiving the mounting portion (110), each one of the ears (121) has a side surface (122) and a mounting hole (123) defined through the ears (121) respectively and aligning to each other.

The shaft (120) is rotatably mounted in the channel and has an outer diameter and two ends extending into the mounting holes (123) of the ears (121) respectively.

The mounting sleeves (21) are mounted around the shaft (120) near the two ends of the shaft (120), are located in the two ends of the channel of the base (11) and correspond to the ears (121), respectively. Each one of the mounting sleeves (21) has a through hole (210) and a flange (211). The through hole (210) is mounted around one end of the shaft (120) and has an inner diameter larger than the outer diameter of the shaft (120), such that the pedal (12) is pivotally connected to the base (11) with shaft (12) and the mounting sleeves (21). The flange (211) abuts with the corresponding ear (121) and has a rubbing surface (212) corresponding to and contacting with the side surface (122) of the corresponding ear (121).

The resilient element (23) may be a spring, is mounted around the shaft (120) between the mounting sleeves (21) and has two ends abutting respectively against the mounting sleeves (21) to push the rubbing surfaces (212) on the flanges (211) of mounting sleeve (21) to abut against the ears (121) on the pedal (12).

The spacers (30) are mounted on the shaft (120) between the rubbing surfaces (212) of the mounting sleeves (21) and the side surfaces (122) of the ears (121).

The retaining element (22) is inverse L-shaped, is secured to the base (11) and has a fixing hole (220) and a screw (221). The fixing hole (220) is formed through the retaining element (22) and aligns with the threaded hole (111) in the base (11). The screw (221) extends through the fixing hole (220) and is screwed into the threaded hole (111) to mount the retaining element (22) securely on the base (11) and hold the mounting sleeves (21) in position.

Figure 4:
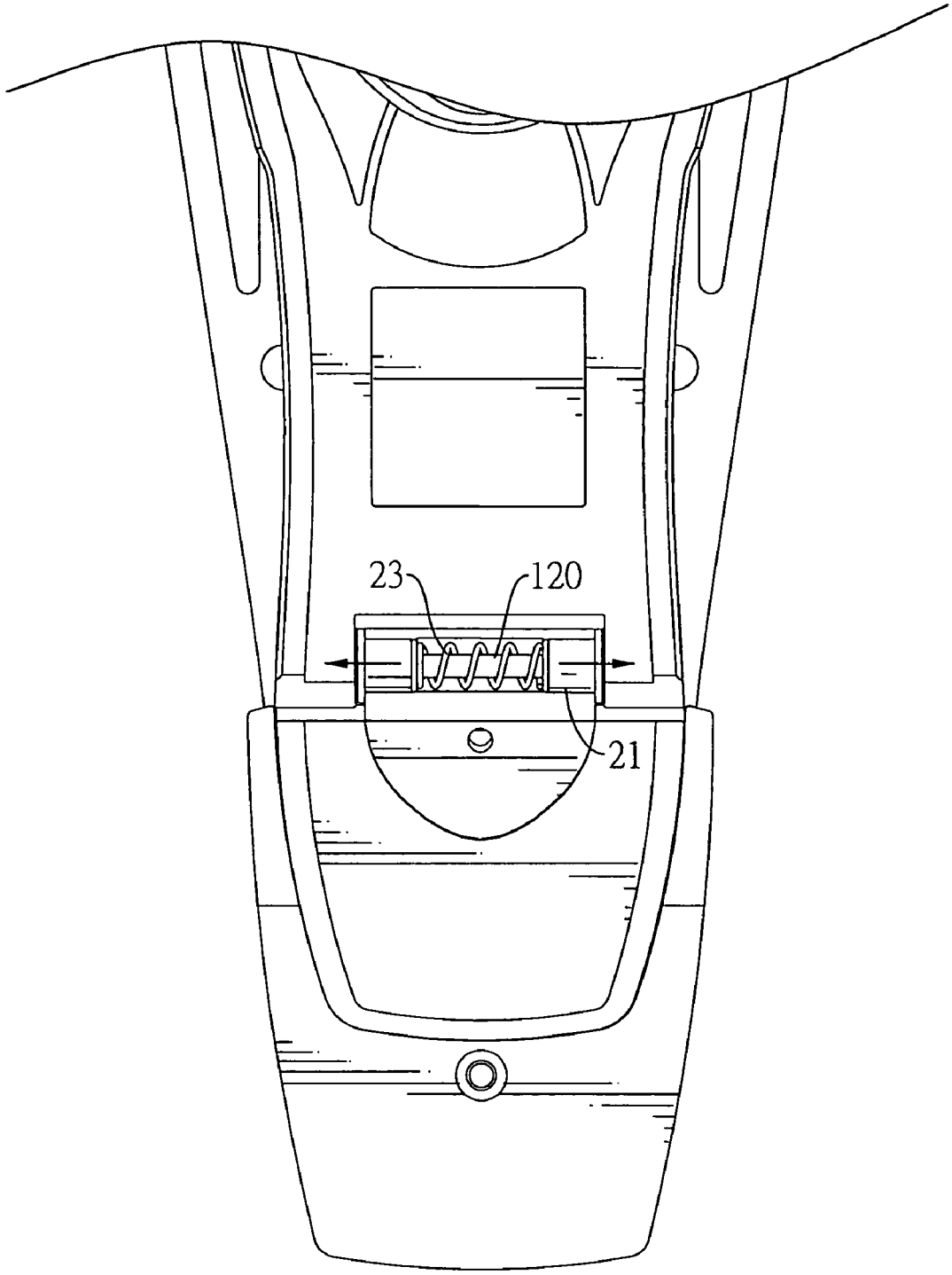
FIG. 4 is an operational top view of the pedal assembly with the retaining element being detached from the base.
Figure 5:
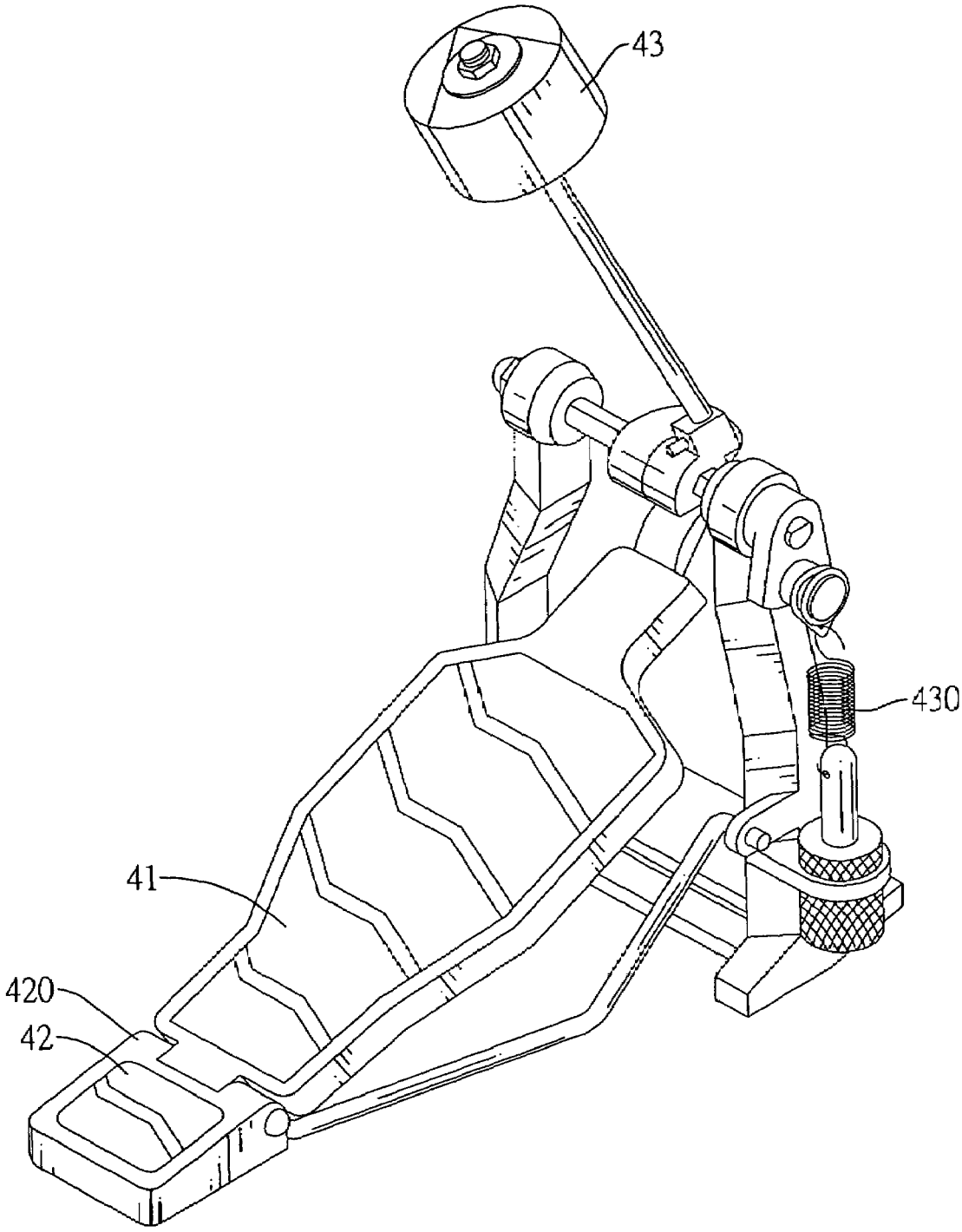
FIG.5 PRIOR ART
FIG. 5 is a perspective view of a conventional pedal assembly in accordance with the prior art.

With further reference to FIG. 4, when gaps occur between the side surfaces (122) of the ears (121) and the rubbing surfaces (212) of the mounting sleeves (21) due to attrition, the retaining element (22) can be detached from the base (11) such that the resilient element (23) will provide a biasing force to push the rubbing surfaces (212) of mounting sleeves (21) to abut closely against the side surfaces (122) of the ears (121). Accordingly, the gaps may be automatically eliminated, such that the operation of the pedal assembly (10) in accordance with the present invention is still kept at a stable condition after a long time of use.

Even though numerous characteristics and advantages of the present invention have been set forth in the foregoing description together with details of the structure and function of the invention, the disclosure is illustrative only. Changes may be made in detail especially in matters of shape, size, and arrangement of parts within the principles of the invention to the full extent indicated by the broad general meaning of the terms in which the appended claims are expressed.

What is claimed is:

1. A pedal assembly comprising:

a base having a mounting portion and a threaded hole formed at a position beside the mounting portion;

a pedal being inclined with respect to the base and pivotally connected to the base and having a pivotal end having two ears formed separately on the pivotal end and pivotally connected with the mounting portion of the base, each ear having a side surface;

two mounting sleeves being mounted in the mounting portion of the base and corresponding to and abutting against the ears of the pedal respectively, each mounting sleeve having a flange with a rubbing surface abutting against the side surface of a corresponding ear of the pedal;

a resilient element mounted between the mounting sleeves and having two ends abutting with the mounting sleeves respectively;

a retaining element being mounted on the base to hold the mounting sleeves securely in position, the retaining element having a fixing hole being formed through the retaining element and corresponding to and aligning with the threaded hole of the base; and a screw extending through the fixing hole of the retaining element and screwed into the threaded hole of the base.

2. The pedal assembly as claimed in claim 1, wherein the pedal further comprises two spacers mounted between the rubbing surfaces of the mounting sleeves and the side surfaces of the ears respectively.

3. The pedal assembly as claimed in claim 1, wherein the mounting portion of the base has a surface; and a channel having two ends longitudinally formed in the surface of the mounting portion to receive the mounting sleeves.

4. The pedal assembly as claimed in claim 3, wherein the ears of the pedal have mounting holes defined through the ears respectively and aligning to each other.

5. The pedal assembly as claimed in claim 4, wherein the mounting sleeves are mounted in the channel of the mounting portion, and each mounting sleeve further has a through hole with an inner diameter, the pedal further including a shaft having an outer diameter smaller than the inner diameter of the through holes of the mounting sleeves and being rotatably mounted through the through holes of the mounting sleeves and extending into the mounting holes of the ears.

6. The pedal assembly as claimed in claim 1 further comprising a beater being pivotally mounted on the base and connected to the pedal;

two resilient elements connected to the beater to return the beater when the beater is pivoting.

7. The pedal assembly as claimed in claim 6, wherein the beater is connected to the pedal via a chain.

* * * * *